US005507524A

United States Patent [19]

Bötschi et al.

[11] Patent Number: 5,507,524

[45] Date of Patent: Apr. 16, 1996

[54] METHOD AND APPARATUS FOR PRODUCING BOOK BLOCKS FROM A STACK OF SIGNATURES

[75] Inventors: Heinz Bötschi, Mauren; Hans Hollenstein, Guntershausen, both of Switzerland

[73] Assignee: Grapha-Holding AG, Hergiswil, Switzerland

[21] Appl. No.: 162,474

[22] Filed: Dec. 7, 1993

[30] Foreign Application Priority Data

Dec. 9, 1992 [CH] Switzerland ..... 3770/92-8

[51] Int. Cl.[6] ..... B42D 1/00; B42B 2/00

[52] U.S. Cl. ..... 281/27; 412/6; 412/35

[58] Field of Search ..... 412/1, 6, 35; 281/27; 112/21

[56] References Cited

U.S. PATENT DOCUMENTS

| | | | |
|---|---|---|---|
| 997,005 | 7/1911 | Pierce | 281/27 |
| 2,583,403 | 1/1952 | Wiser | 281/27 |
| 5,248,234 | 9/1993 | Hollenstein | 412/1 |

FOREIGN PATENT DOCUMENTS

| | | | |
|---|---|---|---|
| 0295220 | 12/1988 | European Pat. Off. . | |
| 0295220B1 | 4/1992 | European Pat. Off. . | |
| 128018 | 12/1900 | Germany . | |
| 595249 | 12/1931 | Germany . | |
| 1096865 | 1/1961 | Germany . | |
| 3623462 | 1/1988 | Germany | 412/35 |

*Primary Examiner*—S. Thomas Hughes
*Attorney, Agent, or Firm*—Spencer & Frank

[57] ABSTRACT

A method and an article are disclosed pertaining to the production of book blocks comprising a stack of signatures each having a fold and which together form a spine of the book block, the signatures being aligned with one another on their flat sides and stitched together by means of a binding thread with at least two spaced transverse seams formed of a double strand of binding thread passing through each of the folds of the signatures from a location outside of the signatures and extending along an inner edge of each of the folds to an exit point in each of the folds, a first one of the at least two spaced transverse seams being formed by chaining together loop-like binding thread sections pulled successively out of the folds of the signature. The chained transverse seam is interrupted after a stack section determining the size of the book block has been formed. A last formed loop-like section of the binding thread is left at an end region of the book block and is unreleasably fastened to at least one of the chained transverse seam and the folds of the signatures.

9 Claims, 2 Drawing Sheets

METHOD AND APPARATUS FOR PRODUCING BOOK BLOCKS FROM A STACK OF SIGNATURES

CROSS REFERENCE TO RELATED APPLICATION

This application claims the priority of Application Ser. No. CH 03,770/92-8, filed Dec. 9th, 1992, in Switzerland, the subject matter of which is incorporated herein by reference.

BACKGROUND OF THE INVENTION

The present invention relates to a method of producing book blocks from a stack of signatures that are aligned with one another on their flat sides and are stitched together by means of a binding thread, with their folds forming the spine of the book block. The book block has at least two spaced transverse seams formed of a double strand of binding thread that passes through the folds of the signatures from the outside and extends along the inner edge of the fold to their exit points. One of the two transverse seams is formed of a chain of loop-like binding thread sections that are successively pulled out of the folds of the signatures, with the chain being interrupted after a stack section has been formed that determines the book block.

EP-A-0,295,220 discloses a method of the above formulated type and a device for implementing the method according to which book blocks are separated from a stack of signatures by cutting through the binding thread at the so-called flat seam under the influence of a tensioning force generated by the moving stack of signatures. These threads are pulled out of the fold of the signatures at the adjacent loop seam or chained seam, respectively, and then cut apart by a knife. This manner of proceeding produces a breather or relaxation, respectively, between the signatures which has a negative influence on the stability of the book blocks and the compactness to be produced by the stitching.

By changing the binding thread from the hook needle to the knife, an additional unreliability moment is created with respect to the transfer.

SUMMARY OF THE INVENTION

It is therefore an object of the present invention to create a method of the above-mentioned type with which the production of book blocks that are stitched with a binding thread can be made more reliable and the device employed can be made simpler.

This is accomplished according to the present invention in that the loop-like section of the binding thread formed for a book block is permanently fastened or anchored, respectively, to the spine of a book block formed by the folds of the signatures or to the chained transverse seam. Thus it becomes possible to further process the book blocks without damage after the stitching.

In this way, it is possible to avoid, for example, an additional empty stitch or a glue connection with the last signature of a book block.

Advantageously, the last loop-like section of the binding thread can be shrunk by means of heat into a form-locking anchorage or can be shrink-connected with the existing transverse seam so that it is impossible for the signature to breathe or the binding seam to be partially loosened.

An alternative type of fastening or anchorage resides in the last loop-like section of the binding thread being fastened to the spine of the book block by supplying a flowable and hardening substance, such as glue, or by welding.

Advisably, the last loop-like section of the binding thread can be cast to the spine of the book block by supplying a castable substance.

In an embodiment that has been found to be favorable, the binding thread is anchored in a form locking manner to the spine of the book block by deformation of its last loop-like section.

A suitable device for implementing the method according to the invention includes, among others, drives for the supplied signatures and the advance of the thus formed stack and for at least two needles (needle pairs) that process the binding thread by stitching. The needle associated with the chained transverse seam is configured as a hook needle which, in the position in which it enters into the signature through the fold, receives the binding thread, by way of a thread carrier that oscillates within the signature, from another needle which penetrates the fold and guides the binding thread. Another drive is provided for a severing device for cutting off the binding thread in that the hook needle has an associated control device for preventing a rotary movement, thus forming an exposed loop-like section of the binding thread at the end of the book block.

BRIEF DESCRIPTION OF THE DRAWING

The method according to the invention will now be described with reference to embodiments thereof illustrated in the drawings.

DETAILED DESCRIPTION OF THE PREFERRED EMBODIMENT

The illustrated stack 1 has been subjected to a sewing process in the direction of arrow A and the signatures 2 required for this purpose were/are each supplied from the bottom to the rear of the moving stack 1. According to the illustration, a stitched book block of three signatures 2 is present as well as a book block which is directly before completion of the stitching process.

Figure 1:
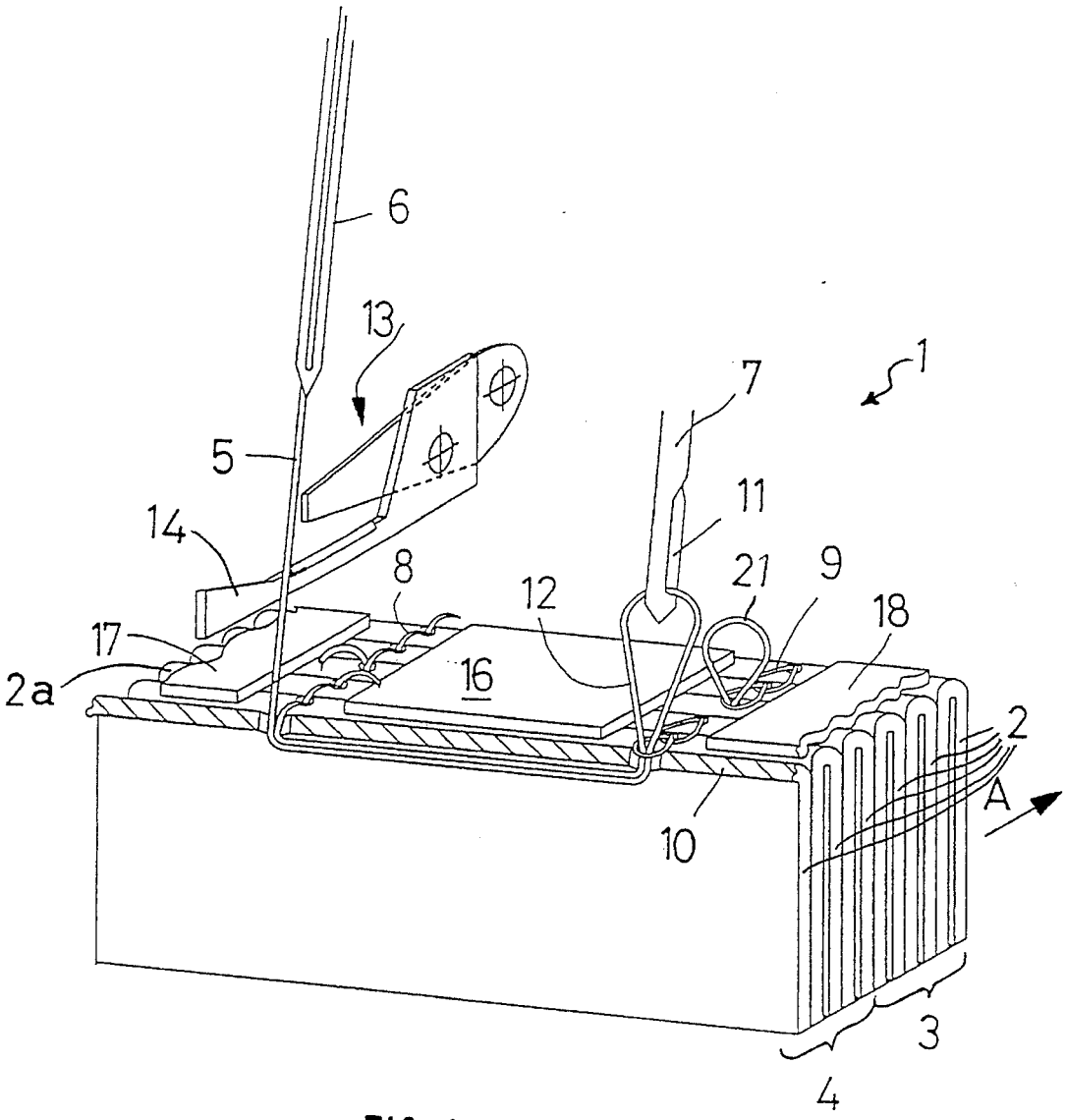
FIG. 1 depicts a stack of signatures composed of two stitched together book blocks.

According to the portion of the fabrication process shown in FIG. 1, a first signature 2*a* intended for the subsequent book block 4 has been placed against the stitched book block 3. This signature was initially prepared from the bottom by means of piercing needles which pass through the fold from the inside out to enable the binding thread 5 in a needle 6 disposed thereabove to be pulled through. With the return movement (not shown) of the piercing needles, needle 6 supplying the binding thread 5, and hook needle 7, which together form a pair of needles for producing two transverse seams 8 and 9, are pushed through the pierced openings in the fold 10 of the signature 2 being processed. A loop is formed of the double-stranded binding thread 5 which is pushed to below the inner edge of the fold, for example by briefly retracting needle 6, so that a so-called thread gripper (not shown) is able to grip binding thread 5 at the resulting loop and transport it to the opposite side associated with transverse seam 9. Here, binding thread 5 is expected by the immersed hook needle 7 and taken over at a hook 11 by a tipping movement of the thread gripper. Thereafter, needles 6 and 7 return to their starting positions above the just processed signature 2 and the thread gripper is returned to its starting positions. This causes a loop or a loop-like section 12 to be formed at binding thread 5 at the hook needle 7 above signature 2. This loop is partially tensioned by a resetting force and extends along the inner edge of the fold.

Then the hook needle 7 is rotated about 180° so that hook 11 is oriented in a direction opposite to the direction of advance of stack 1. This rotation of hook needle 7 serves to chain the loop-like section 12 so that the latter is unable to lip from hook needle 7, but instead loops around the latter when it is lowered for the next signature 2, with the tensioning force acting on binding thread 5 reducing the size of loop-like section 12 corresponding to the distance from the next signature 2. On its way into its position within the next signature 2, hook needle 7 turns back into the position in which hook 11 is oriented in the direction of advance A of stack 1.

For the present case, where four signatures 2 form a book block 3 or 4, respectively, this process is repeated twice after the first signature and is changed for the fourth, that is, the last signature 2 for a book block in that hook needle 7 no longer rotates after the formation of loop-like section 12 so that the latter, when hook needle 7 is lowered for the first signature of the next book block, is released from hook 11 and from hook needle 7, thereby causing an interruption of the chained transverse seam and resulting in a last formed loop-like section 21 as shown in FIG. 1. The thread tension is now initially released and, in the present case, the cutting device 13 is used and moved to the side in such a way that the binding thread 5, during the mentioned lifting movement of needle 6, places itself around a cutting blade 14 at cutting device 13. For the cutting process to be performed without malfunction, it is recommended to employ a scissors-like cutting device 13 with which it is possible to avoid further pulling on the retensioned binding thread 5 at the loop-like section.

In the further course of the stitching operation, namely when it is positioned between two scissor blades by the signatures 2 or book blocks 3 and 4 that continue to be displaced in the direction of arrow A, the binding thread 5 lying above the lower scissors blade is cut. Until this moment, the binding thread is displaced above the scissors blade together with its associated signature 2.

As an aid, the region of binding thread 5 to be cut could be clamped in at the closest needle plate 16, 17, 18 so as to avoid stresses. The latter serves as a hold-down member for signatures 2 and as a protection against binding thread 5 tearing out of signatures 2 during the stitching process.

Figure 2:
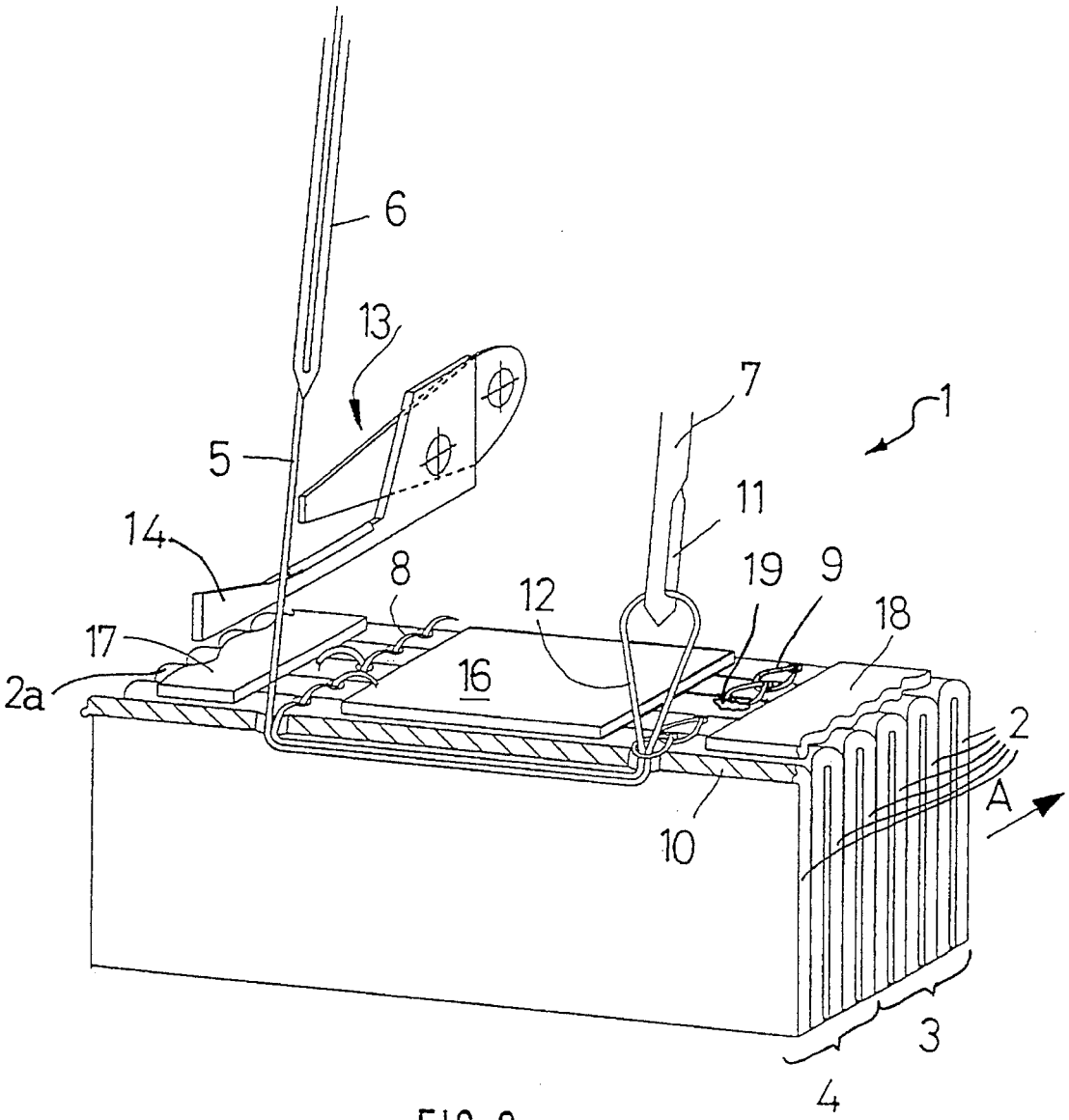
FIG. 2 is a view similar to that of FIG. 1, where the last formed loop-like section is shown as being fastened in place by either being shrunk or glued.

FIG. 2 shows the last loop-like section 21 of the binding thread as being shrunk by means of heat into a form-locking anchorage, or shrink-connected with the existing transverse seam at location 19. Location 19 can be viewed as alternately showing the last loop-like section as being fastened by glue to the spine of the book block.

It will be understood that the above description of the present invention is susceptible to various modifications, changes and adaptations, and the same are intended to be comprehended within the meaning and range of equivalents of the appended claims.

What is claimed is:

1. In a method of producing book blocks from a stack of signatures each having a fold and which together form a spine of a book block, including the steps of:

aligning the signatures with one another on their flat sides; and stitching the signatures together by means of a binding thread with at least two spaced transverse seams formed of a double strand of binding thread passing through each of the folds of the signatures from a location outside of the signatures and extending along an inner edge of each of the folds to an exit point in each of the folds, one of the at least two spaced transverse seams being a chained transverse seam formed by chaining together loop-like binding thread sections pulled successively out of the folds;

the improvement comprising the steps of:

interrupting the chained transverse seam thereby forming a stack section determining the size of the book block such that a last formed loop-like section of the binding thread remains unchained and is left at an end region of the book block; and unreleasably fastening the last formed loop-like section to at least one of the chained transverse seam and the folds of the signatures.

2. The method according to claim 1, wherein said step of unreleasably fastening comprises the step of effecting a shrink connection of the last formed loop-like section with the chained transverse seam.

3. The method according to claim 2, wherein said step of effecting a shrink connection comprises the step of heat-shrinking the last formed loop-like section.

4. The method according to claim 1, wherein said step of unreleasably fastening comprises the step of welding.

5. The method according to claim 1, wherein said step of unreleasably fastening includes the step of supplying the last formed loop-like section with a flowable substance which subsequently hardens to bind the last formed loop-like section to the spine of the book block.

6. The method according to claim 1, wherein said step of unreleasably fastening includes the step of encasing the last formed loop-like section together with the spine of the book block by means of a flowable substance.

7. The method according to claim 1, wherein said step of unreleasably fastening includes the step of deforming the last formed loop-like section so as to anchor the binding thread in a form-locking manner to the spine of the book block.

8. The method according to claim 1 and further including the step of cutting off, at the end region of the book block, the binding thread of a second one of the at least two transverse seams.

9. In a book block comprising a stack of signatures each having a fold and which together form a spine of the book block, the signatures being aligned with one another on their flat sides and stitched together by means of a binding thread with at least two spaced transverse seams formed of a double strand of binding thread passing through each of the folds of the signatures from a location outside of the signatures and extending along an inner edge of each of the folds to an exit point in each of the folds, a first one of the at least two spaced transverse seams being formed by chaining together loop-like binding thread sections pulled successively out of the respective folds;

the improvement wherein:

the chained transverse seam is interrupted thereby forming a stack section determining the size of the book block such that a last formed loop-like section of the binding thread remains unchained and is left at an end region of the book block; and the last formed loop-like section is unreleasably fastened to at least one of the chained transverse seam and the folds of the signatures.

* * * * *